US005505262A

United States Patent [19]

Cobb

[11] Patent Number: 5,505,262

[45] Date of Patent: Apr. 9, 1996

[54] FLUID FLOW ACCELERATION AND PULSATION GENERATION APPARATUS

[76] Inventor: Timothy A. Cobb, 4518 B St. Andrews Dr., Midland, Tex. 79707

[21] Appl. No.: 357,101

[22] Filed: Dec. 16, 1994

[51] Int. Cl.[6] ..... E21B 7/24; E21B 7/18; E21B 21/00; E21B 37/00

[52] U.S. Cl. ..... 166/312; 134/198; 137/808; 175/323; 175/67; 239/589.1

[58] Field of Search ..... 175/67, 393, 424, 175/418, 323; 299/17, 14; 134/1, 198; 166/222, 223, 249, 312, 197; 137/808, 809; 239/589.1

[56] References Cited

U.S. PATENT DOCUMENTS

| | | | |
|---|---|---|---|
| 3,576,222 | 4/1971 | Acheson et al. | 175/67 |
| 4,114,705 | 9/1978 | Milan | 175/67 X |
| 4,389,071 | 6/1983 | Johnson, Jr. et al. | 175/67 X |
| 4,687,066 | 8/1987 | Evans | 166/222 X |
| 4,694,901 | 9/1987 | Skinner | 166/122 X |
| 4,852,668 | 8/1989 | Dickinson, III et al. | 175/67 |
| 4,919,204 | 4/1990 | Baker et al. | 166/223 |
| 5,135,051 | 8/1992 | Facteau et al. | 166/104 |
| 5,165,438 | 11/1992 | Facteau et al. | 137/1 |
| 5,228,508 | 7/1993 | Facteau et al. | 166/177 |

*Primary Examiner*—Stephen J. Novosad
*Attorney, Agent, or Firm*—Akin, Gump, Strauss, Hauer & Feld

[57] ABSTRACT

A fluid accelerating and pulsation generating apparatus for minimizing loss in fluid energy through frictional pressure drop for fluid passing through the apparatus is characterized by a body having a generally cylindrical chamber formed by a cylindrical inner wall and opposed transverse end walls. One of the end walls has one or more fluid inlet ports arranged therein and defined by passages which intersect the end wall at an angle with respect to a plane normal to the central longitudinal axis of the chamber and generally tangentially with respect to the cylindrical inner wall. Plural discharge passages intersect the opposite end wall at a curved wall portion formed between the cylindrical inner wall and the opposite end wall. The discharge passages may also be arranged to have their axes extending tangentially with respect to the inner cylindrical wall and at a predetermined angle with respect to a plane normal to the central longitudinal axis of the chamber. Pulsation generating ball members may be disposed in the chamber and engageable with the curved wall portion to momentarily cover the discharge passages as the ball members are propelled by spiral fluid flow through the chamber. The apparatus minimizes fluid pressure losses for fluid flowing therethrough and is operable to generate pulsed flow. The apparatus may be used as a fluid mixing and application device, for jet blast cleaning, material removal, and in wellbore operations for wellbore cleanout, fluid flow inducement and improved well drilling.

20 Claims, 5 Drawing Sheets

FLUID FLOW ACCELERATION AND PULSATION GENERATION APPARATUS

FIELD OF THE INVENTION

This invention pertains to an apparatus for accelerating fluid flow to minimize frictional pressure losses through a conduit or nozzle and which may include a pressure pulsation generator applicable in hydraulic jet blast cleaning, earth drilling and oil and gas production well cleaning operations.

BACKGROUND OF THE INVENTION

There are many fluid flow devices wherein fluid passes from a passage having a first cross sectional flow area into a passage of a larger cross sectional flow area and fluid is then required to flow through a further passage of reduced cross sectional flow area or to be ejected through a nozzle. Such changes in flow area often result in unwanted frictional pressure loss. Moreover, in many instances, the fluid conveying device or apparatus is arranged such that fluid will flow from a first passage into a second passage of larger cross sectional flow area and length and wherein the flow streamlines are interrupted and turbulence is generated which also results in friction pressure drop energy losses. Such energy losses may be undesirable in many fluid flow conveying devices and thus there has been a long felt need to minimize such losses.

There are several applications of fluid conveying devices wherein the above-mentioned pressure and energy losses are desired to be minimized. One application is in fluid mixing devices wherein two liquids are to be mixed, one liquid and one gas are to be mixed, two gasses are to be mixed, or a liquid or a gas is to be mixed with particulate solids for various purposes including a resultant chemical reaction or mechanical application of the fluids, such as preparation of cement mixtures, mixing drilling and fracturing fluids for well operations, spray painting and spray application of polymer coatings and similar materials. Still further, it is often desirable to provide mixing of liquids or gasses with fine particulate solids such as in mechanical abrasion applications or to merely disperse the solids in the fluid flow stream without reducing the flow stream energy.

Yet another application of fluid conveying devices wherein it is desirable to minimize fluid flow energy losses is in pulsed flow generation wherein fluid is used as a jet blast medium and the momentary interruption of fluid flow from a nozzle or the like is advantageous in the operation of the device such as in article cleaning applications and operations to otherwise remove material from a surface. Still further, in operations such as earth drilling or the use of high pressure jet penetrating devices, it is desirable to minimize energy loss in the fluid such as frictional pressure drops through the fluid conveying structure before the fluid is ejected therefrom. The present invention is directed to the above-mentioned ends as well as other objectives discussed herein.

SUMMARY OF THE INVENTION

The present invention provides an improved fluid conveying device which is operable to accelerate fluid flow while minimizing frictional pressure loss when fluid is conveyed from a passage of one cross sectional flow area to a passage of another cross sectional flow area and then is required to flow through a third passage of yet another cross sectional flow area. The second passage is preferably defined by a cylindrical chamber in which fluid flow is accelerated along a spiral or helical flow path, and the cross sectional flow area is greater than the first and third passages. The present invention also provides an improved fluid flow accelerator which minimizes fluid energy loss, particularly friction pressure loss, for devices wherein fluids are being mixed and ejected therefrom, such as fluid mixing nozzles and the like. One embodiment of a device in accordance with the invention is operable to advantageously generate vortical flow in a fluid occupied space such as a wellbore.

In accordance with another important aspect of the present invention a unique fluid pulsation generator is provided wherein fluid enters a chamber in the pulsation generator body in a direction which induces spiral or vortical flow. Fluid is discharged from the body through plural ports which are disposed in a predetermined direction to receive the fluid flow in a way which minimizes energy losses in the fluid and which also propels a pulsation generating member within the chamber in an improved manner. The pulsation generator includes a preferred orientation of fluid inlet and discharge ports which cause fluid flow to form a vortex in a chamber in the device wherein momentum created by the vortical flow minimizes changes in fluid flow rate through the discharge ports and minimizes energy losses in the fluid.

In accordance with yet a further aspect of the present invention, an improved fluid pressure pulsation generator is provided which is particularly useful in applications for hydraulic jet blast cleaning and for dislodging solids materials accumulated on the walls of a wellbore or well perforation tunnels into a fluid producing earth formation. One embodiment of the invention provides an improved well cleanout tool which is operable to clean casing perforations and to induce vortical flow of fluid in a wellbore to create a pressure differential which will stimulate fluid flow from an earth formation in communication with the wellbore.

The invention still further provides an improved drilling apparatus, particularly useful in well drilling wherein fluid used in conveying drill cuttings and the like is also conveyed through a sub interposed in a drill string adjacent to the drill bit. The sub is operable in accordance with the invention to generate pulsed fluid flow to improve the rate of material removal in drilling a well or penetrating other solid material. An improved method of removing material from wellbores is also provided by the invention.

The important aspects of the invention above-mentioned as well as other superior features will be further appreciated from reading the detailed description which follows in conjunction with the drawing.

DETAILED DESCRIPTION OF THE PREFERRED EMBODIMENTS

Figure 1:
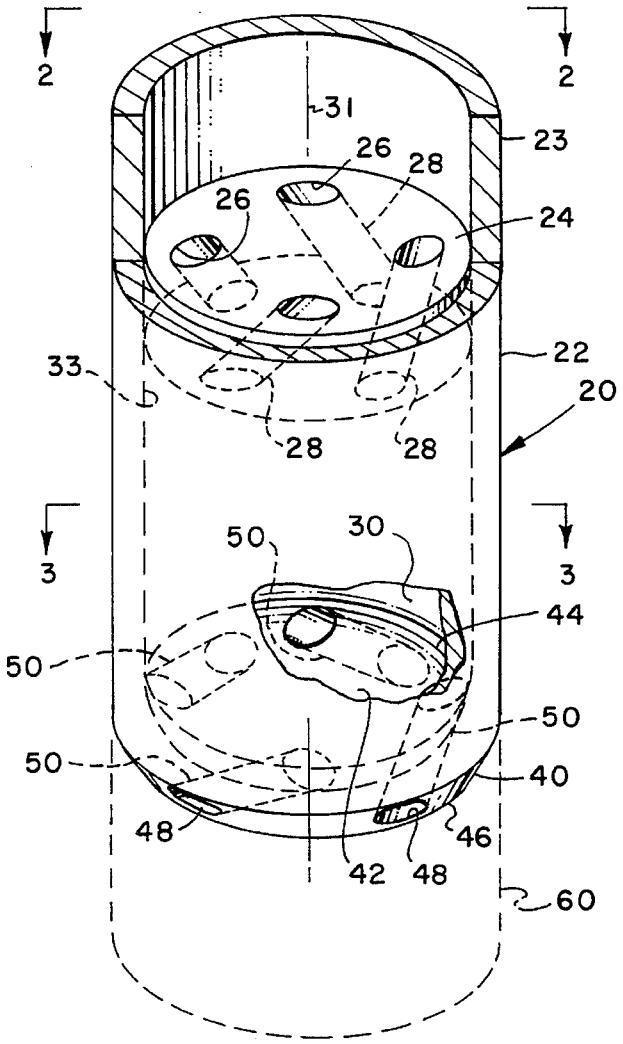
FIG. 1 is a perspective view of one embodiment of a fluid conveying and acceleration apparatus in accordance with the present invention.

In the description which follows like parts are marked throughout the specification and drawing with the same reference numerals, respectively. The drawing figures are not necessarily to scale in the interest of clarity and conciseness.

Referring to FIG. 1, there is illustrated a fluid conveying apparatus which is operable to accelerate fluid flow therethrough to minimize fluid energy loss, primarily due to frictional pressure losses. The apparatus is generally designated by the numeral 20 and includes a generally cylindrical body 22 which is operable to be connected to a fluid conveying conduit 23 at an inlet end of the apparatus. The body 22 is modified to include a generally cylindrical transverse end wall or plug portion 24 which is provided with fluid inlet passage means comprising one or more circumferentially spaced fluid inlet ports 26 formed therein. The ports 26 form openings for respective passages 28 which extend through the end wall 24 and open in into an enlarged diameter chamber 30 of the body 22, which diameter is preferably about one-half the length of the chamber 30.

Figure 2:
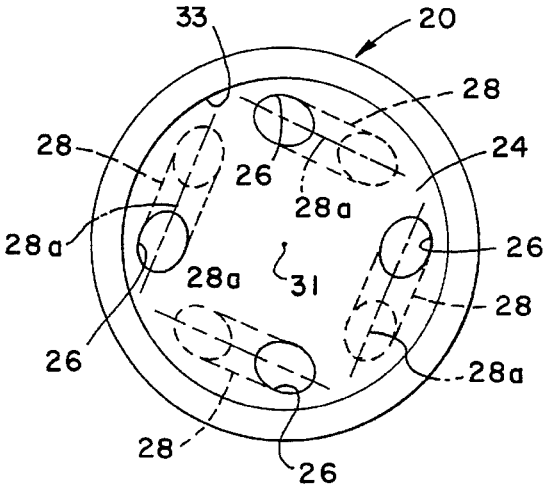
FIG. 2 is a view taken generally from the line 2—2 of FIG. 1.

As shown in FIGS. 1 and 2, the passages 28 intersect a plane normal to the central longitudinal axis 31 of the body 22 at an acute angle, which may be in a range of about 30° to 60°. Forty-five degrees (45°) is a preferred value. The passages 28 also have central axes 28*a* substantially tangential to the inner cylindrical wall 33 defining the chamber 30. Four passages 28 are illustrated in FIG. 2 although a larger or smaller number, including just one, of such passages may be provided. The diameter of the ports 26 and the passages 28 may also be varied to minimize pressure loss of fluid flowing therethrough into the chamber 30.

Figure 3:
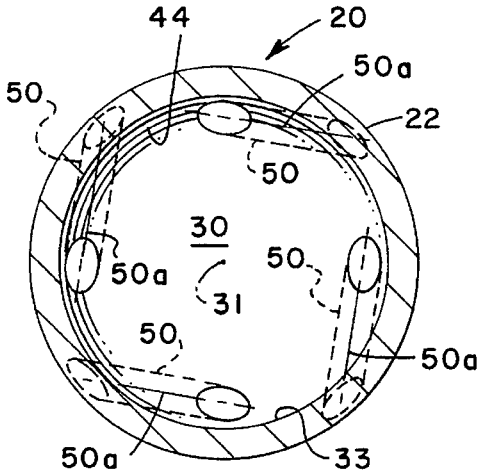
FIG. 3 is a section view taken generally from the line 3—3 of FIG. 1.

Referring further to FIG. 1 and also FIG. 3, the body 22 may, for certain applications, have a discharge end portion 40 defined by a transverse end wall 42 delimiting the chamber 30 and intersecting the sidewall 33 at a curved inner wall portion 44 which may have a predetermined circular radius of curvature in accordance with a second embodiment of the invention described hereinbelow. The body portion 40 may have a frusto-conical exterior sidewall portion 46 which is intersected by plural fluid discharge ports 48, see FIGS. 1 and 4. The discharge ports 48 form the discharge ends of respective plural discharge passages 50 which intersect the curved interior wall 44, see FIG. 3, at spaced apart ports 51, generally aligned with the fluid inlet ports 26, for example. The passages 50 may be configured such that their central longitudinal axes 50*a* are tangential to the circumferential wall 33 and intersect the plane of the end wall 42 at an angle of from 45° to 60°. The end wall 42 extends in a plane normal to the axis 31. The diameter of the ports 48 and the passages 50 and the number of same may be selected to minimize fluid pressure losses as the fluid flows through the passages to exit the body 22. However, an important aspect of the invention resides in the arrangement of the passages 28 and 50 which induce generally spiral or vortical flow of fluid through the chamber 30 and are aligned with this vortical flow, respectively, to discharge fluid from the apparatus 20 without significant energy loss, due to minimal friction pressure losses, as fluid flows through the apparatus 20.

Figure 4:
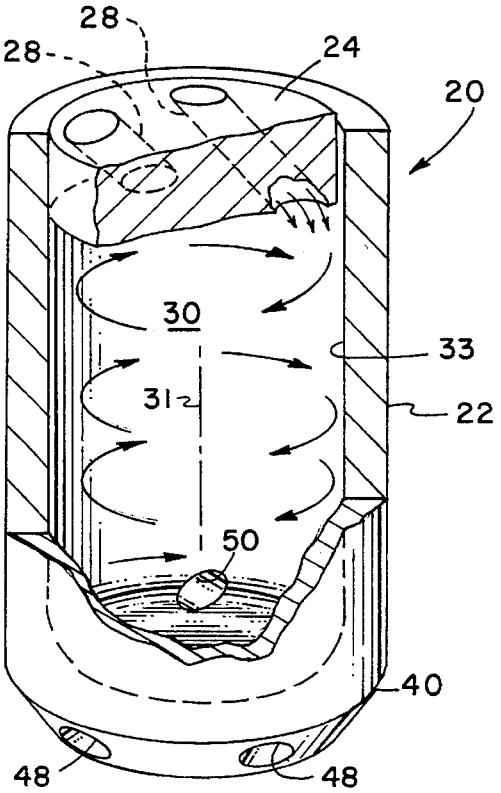
FIG. 4 is a perspective view broken away to show a portion of the fluid flow pattern of the fluid exiting the inlet ports into the larger diameter chamber of the embodiment of FIG. 1.
Figure 5:
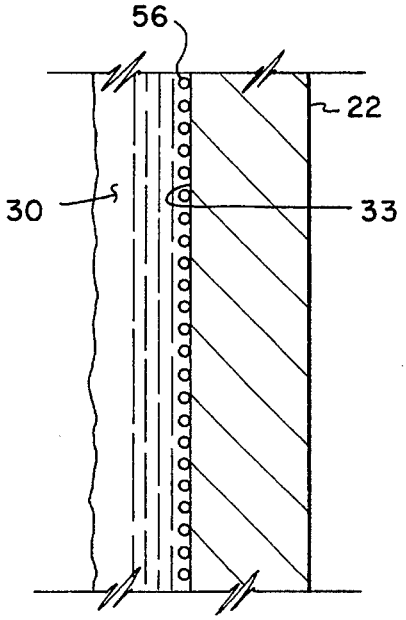
FIG. 5 is a detail section view showing the flow pattern along the wall of the enlarged diameter chamber of the embodiment shown in FIG. 4.

FIGS. 4 and 5 illustrate how fluid flowing from the passages 28 into the chamber 30 "spreads out" and flows along the cylindrical wall 33 in a spiraling, vortical path. In a steady state operation of the apparatus 20, that is with constant fluid flow rate thereinto, fluid will exit through the passages 50 with minimal pressure drop through the apparatus. The fluid pressure within the chamber 30, particularly in the area near the central axis 31, is reduced due to the vortical flow which enhances the flow velocity of the fluid. Since the passages 50 are generally aligned with the direction of flow of fluid along the wall 33, fluid will exit through these passages with minimal turbulence and associated frictional pressure losses. The apparatus 20 is sized such that a laminar flow boundary layer 56, see FIG. 5, is advantageously formed along and immediately adjacent to the wall 33 whereupon the bulk of the fluid flowstream passing through the chamber 30 is not adversely affected.

Fluid exiting the discharge ports 48 may be conveyed through a continuing conduit 60, FIG. 1, or may advantageously be caused to induce fluid flow in a space surrounding the apparatus 20 in a generally spiral or vortical manner. Fluid exiting the ports 48 may also be impacted against a surface such as in a jet blast cleaning application, the application of paints or coatings to a surface, abrasive cleaning or material removal, or in applying material to a surface such as two part, catalyst activated polymers, for example. If, for example, the body 22 forms a nozzle head for a jet blast cleaning system, the fluid flow exiting the ports 48 may be directed against a surface to effect material removal therefrom with reduced energy loss, thanks to the configuration of the body 22 and the arrangement of the passages 28 and 50 in the end walls thereof.

Figure 6:
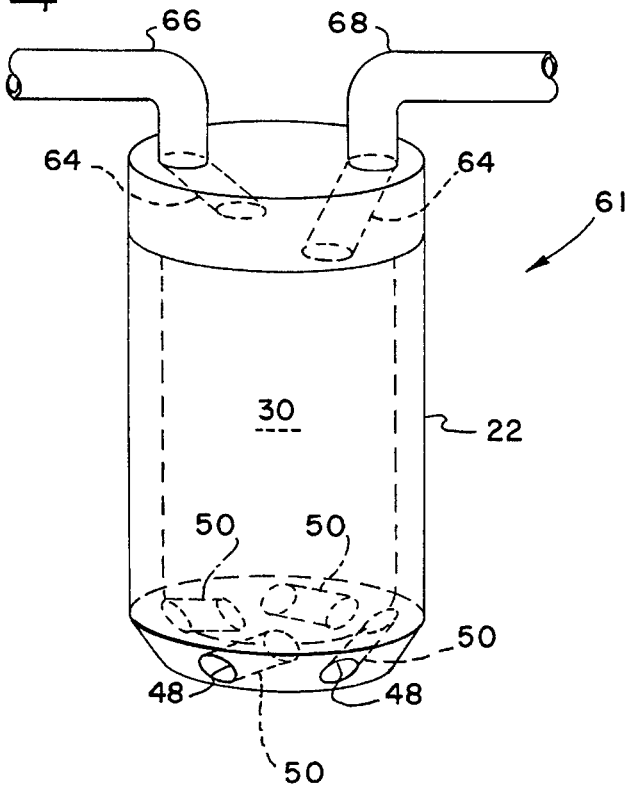
FIG. 6 is a perspective view of a fluid mixing device in accordance with the present invention.

FIG. 6 illustrates certain details of an embodiment of the invention comprising an apparatus 61 including the body 22 and wherein the body 22 is connected to an inlet transverse end wall or plug portion 62 in place of the plug 24 and which has at least two circumferentially spaced passages 64 arranged therein which are generally tangential with the wall 33 and which intersect a plane normal to the axis 31 at an angle of from 30° to 60°. The passages 64 are, respectively, connected to fluid conveying conduits 66 and 68 which are in flow communication with the chamber 30 for discharging two fluids thereinto to flow in a generally spiral and vortical manner. The fluids being injected into the chamber 30 may be, for example, a polymer and a catalyst fluid which are then thoroughly mixed in the chamber 30 and are ejected through the discharge passages 50 for application to a surface such as forming a coating, or building up a relatively thick layer of material such as in the construction of fiber reinforced plastic articles. Still further, one of the conduits 66 or 68 may be conducting a carrier fluid into the chamber 30 to be mixed with particulate solids such as glass beads or sand, which solids are conveyed by the other conduit into the chamber 30 and mixed in the chamber with the carrier fluid. The solids laden fluid is then ejected through the passages 50 for use in sand blasting or similar cleaning or material removal operations. Again, thanks to the arrangement of the passages 64, the chamber 30 and the discharge passages 50, minimal energy loss in the fluid flowstream passing through the apparatus 61 is experienced and improved operation of a device for any of the above-mentioned applications may be realized.

Figure 7:
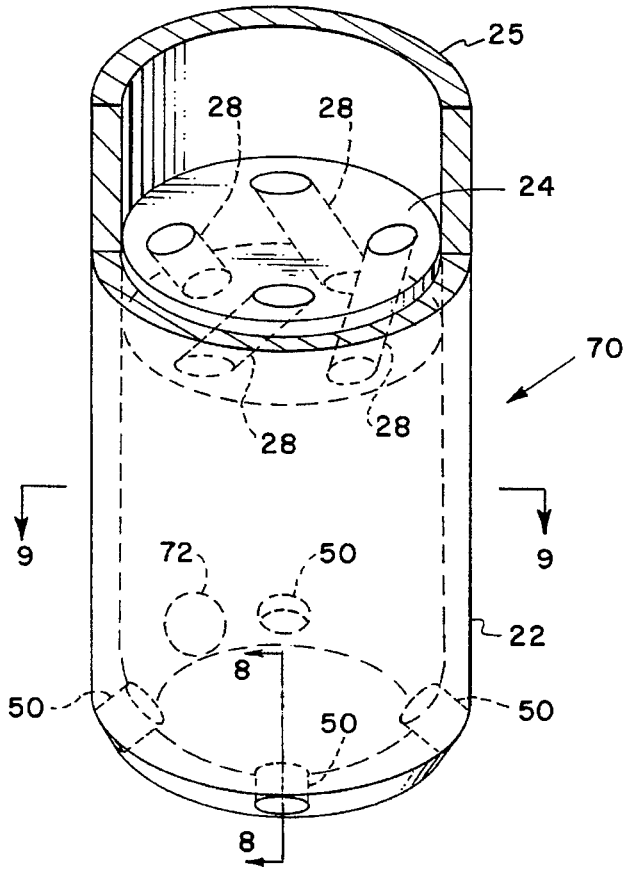
FIG. 7 is a perspective view of a fluid pulsation generator in accordance with the invention.
Figure 8:
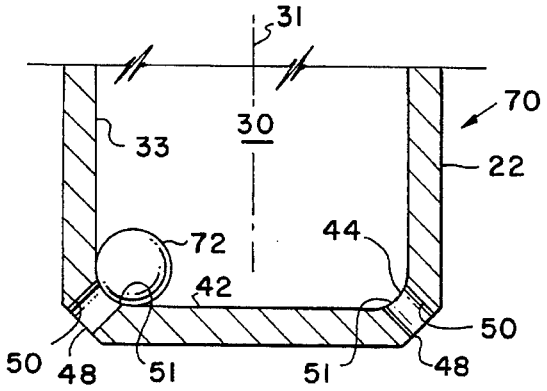
FIG. 8 is a detail section view taken generally from the line 8—8 of FIG. 7.

Referring now to FIGS. 7 and 8, another embodiment of an apparatus in accordance with the invention is illustrated and generally designated by the numeral 70. The apparatus 70 is similar in some respects to the apparatus 20 and 61 and includes a cylindrical body 22 with plural fluid discharge ports 48 in communication with discharge passages 50 which intersect the curved wall portion 44. In the apparatus 70 each of the passages 50 extends in a plane, respectively, normal to the plane of the end wall 42 and at an angle of about 45° to the axis 31. The apparatus 70 includes a fluid inlet end body part 24 which is in communication with a fluid conducting conduit 25 in a manner similar to the arrangement of the apparatus 20. However, as shown in FIGS. 7 and 8, a generally spherical fluid flow pulsation-generating member 72 is disposed in the chamber 30.

The spherical ball-like member 72 has a radius of curvature approximately the same as the radius of curvature of the wall portion 44 and is operable to be nested in the wall portion 44 wherein the wall portion may be considered a raceway for the ball member 72. The generally spiral, vortical type flow pattern within the chamber 30 generated by fluid exiting the passages 28, together with the arrangement of the discharge passages 50, induces the member 72 to roll rapidly around and in contact with the curved wall portion 44 under propulsion by the fluid flow. Moreover, the member 72 is confined to rolling in the chamber 30 in contact with the wall portion 44 due to centrifugal forces acting on the member. As the member 72 rolls around the chamber 30 in contact with the curved wall 44, it passes over inlet ports 51 of the passages 50 which intersect the curved wall or raceway 44, FIG. 8. The diameter of the member 72 is sufficiently greater than the diameter of the ports 51 that the member 72 will pass thereover without adversely impacting the edges of the ports 51, but also momentarily closing off fluid communication from the chamber 30 with the passages 50.

The successive and rapid closing and opening of the passages 50 as the member 72 rotates in the chamber 30, creates a substantial pulsed flow effect of fluid being discharged through the passages 50. Of course, the passages 50 which are not covered instantaneously by the member 72 are conducting fluid therethrough to be ejected through the ports 48 substantially uninterrupted and with minimal energy loss as fluid flows leaves the body 22. Accordingly, the substantial pulsating effect generated by the member 72 may be used advantageously in hydraulic jet blast cleaning and other material removal or transport applications.

Figure 9:
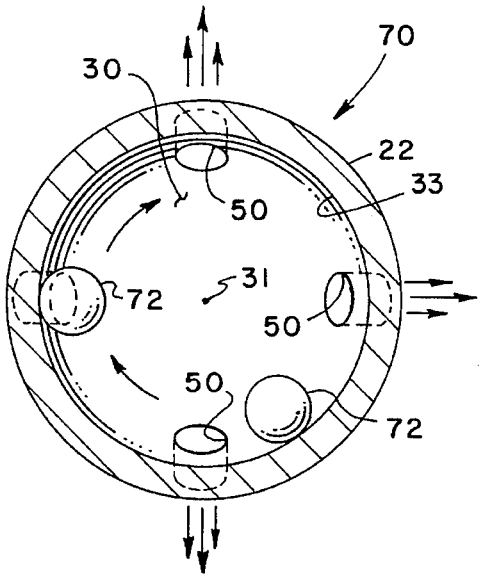
FIG. 9 is a section view taken generally from the line 9—9 of FIG. 7 and showing plural pressure pulsation generating balls disposed in the vortex flow chamber.

Referring briefly to FIG. 9, there is illustrated a modification to the apparatus 70 wherein plural ball members 72 are disposed in the chamber 30 and are operable to be propelled around the raceway defined by the curved wall 44. An increase in the frequency of the pulsating flow discharged from the apparatus 70 may be obtained, when desired, by providing at least one more of the pulsation generating ball members 72 within the chamber 30, as illustrated.

Figure 10:
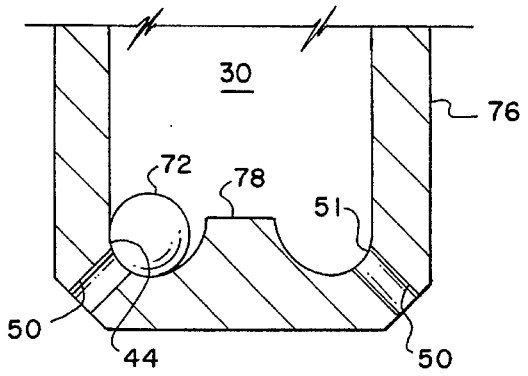
FIG. 10 is a detail section view showing a modification of the embodiment of FIG. 7.

Referring briefly to FIG. 10, there is illustrated a modification to the body 22, generally designated by the numeral 76, wherein the curved wall portion 44 is further defined by a central, generally longitudinally extending boss 78 which further defines the raceway for one or more of the ball members 72. The arrangement illustrated in FIG. 10 gives further assurance that a ball member 72 will stay within the raceway defined by the curved wall portion 44 and the boss 78.

Figure 11:
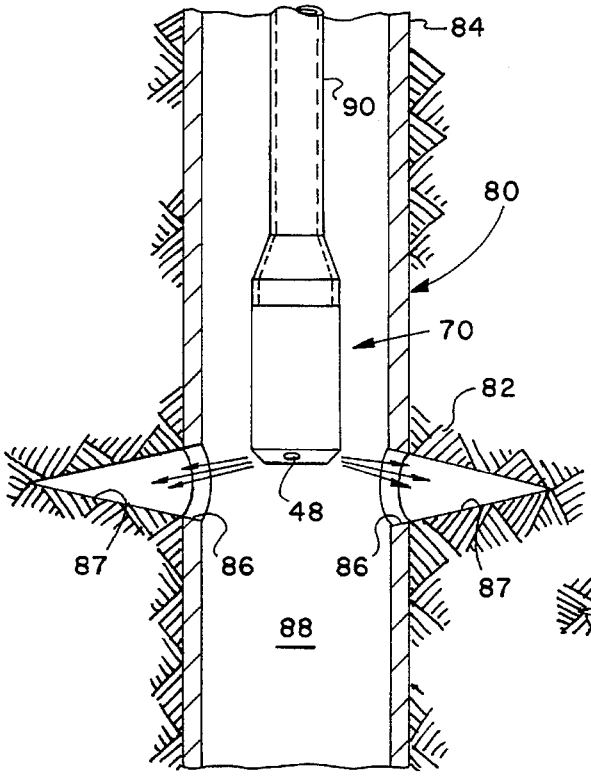
FIG. 11 is a somewhat schematic view of a cased and perforated well which is being cleaned by a device in accordance with the embodiment of FIG. 7.

Referring now to FIG. 11, there is illustrated one advantageous application of the apparatus 70 for cleaning or dislodging material within a fluid production or injection well in the earth. FIG. 11 illustrates a portion of a well 80 penetrating an earth formation zone 82 and defined by a casing 84 which is perforated at 86 to place a wellbore space 88 in communication with the fluid producing formation. In many instances, the formation zone 82, at the perforations 86, will become plugged with a skin of "filter cake" of drilling or completion fluid, entrained solids or residue from other wellbore operations and which affects fluid production from the formation zone 82. Moreover, in certain fluid injection wells, the earth formation portion in communication with the perforations 86 will often become plugged with fine solids particulates over time.

However, with the provision of the apparatus 70, conveyed into the wellbore 88 attached to an elongated tubing string 90 in place of the conduit 25, for example, pressure fluid may be injected through the tubing string 90 from the surface, not shown, and discharged from the ports 48 in a pulsating flow directed at the perforations 86 to effect dislodging solid material from the cavity walls 87 in the formation zone 82 which delimit the perforations. With the configuration of the apparatus 70, high pressure fluid is ejected from the ports 48 in a pulsating manner to advantageously dislodge the "skin" or "filter cake" accumulated in the perforations 86 and the walls 87. The apparatus 70 may also be used in other cleanout operations including removal of sand from the wellbore 88 or scale which has accumulated on the interior wall surfaces of the casing 84 or on fluid production or injection tubing, not shown, extending within the well 80.

Figure 12:
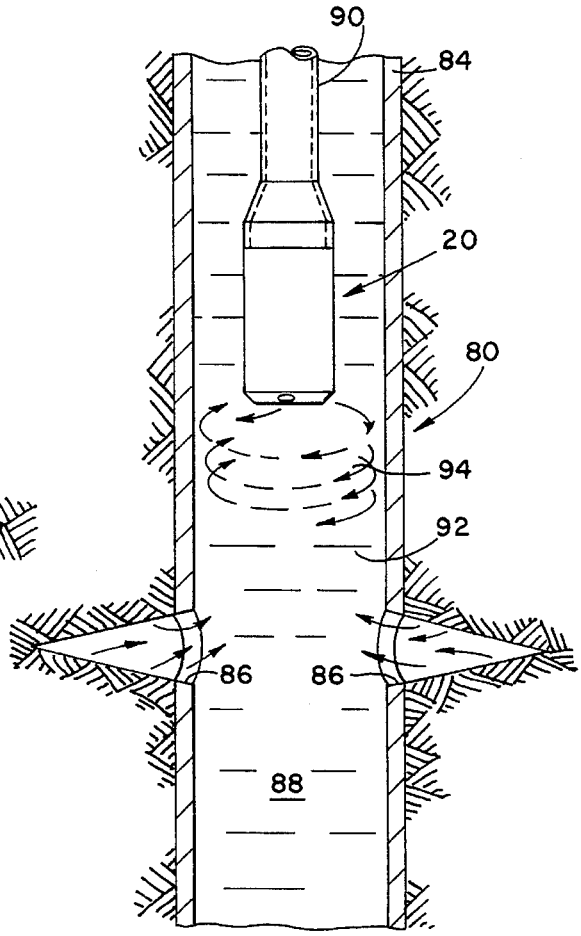
FIG. 12 is a schematic view of a well in which fluid flow from an earth formation penetrated by the well is enhanced by a device in accordance with the invention.

FIG. 12 shows yet another application of an apparatus in accordance with the invention wherein the apparatus 20, for example, may be connected to a tubing string 90 extending within the well 80 and having the discharge passages 50 directed in a manner which will assure a vortical or spiral flow of fluid ejected from the apparatus 20 within the wellbore 88. In this way, fluid 92 in the wellbore space 88 will experience a pressure reduction within a vortical flow field 94 which will aid in stimulating formation fluids to flow from the formation zone 82 into the wellbore 88 by way of the perforations 86. Accordingly, the apparatus 20 may effect circulation of wellbore fluid 92 in such a way which, not only causes solids material deposited in the perforations 86 and the wellbore space 88 to be induced to flow upward through the wellbore toward the surface, but also to create a pressure differential in the vicinity of the perforations 86 which will aid in stimulating fluid flow into the well 80 from the formation zone 82.

Figure 13:
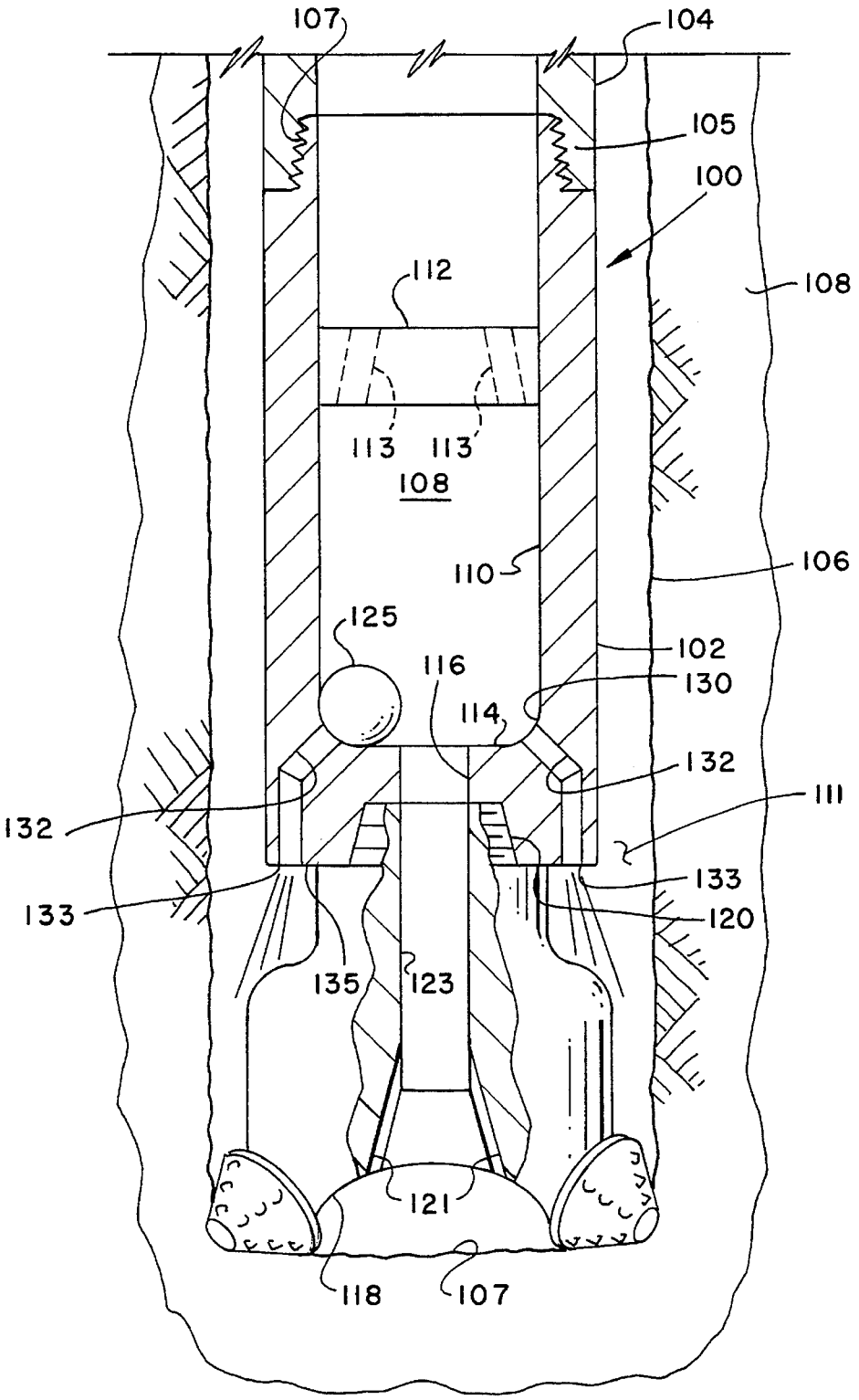
FIG. 13 is a longitudinal section view of a drilling apparatus in accordance with the invention.

Referring now to FIG. 13, there is illustrated yet another embodiment of an apparatus in accordance with the invention and generally designate by the numeral 100. The apparatus 100 is configured as a drilling sub defined by a generally cylindrical tubular body 102 which is interposed in an elongated drill string 104 operable to drill a hole or well 106 in material such as an earth formation 108. The drill string 104 includes a conventional string of drill pipe, including a section 105, the lower end of which is illustrated in FIG. 13 and which is suitably connected to the sub 102 at a conventional threaded connection 107. The sub 102 includes a chamber 108 defined by an inner cylindrical wall 110 which is delimited at its upper end by a transverse wall or plug portion 112. A transverse end wall 114 is formed at the opposite end of the chamber 108. The transverse end wall 114 includes a central longitudinal passage 116 formed therein which is in communication with a conventional drill bit 118 threadedly coupled at 120 to the sub 102. The drill bit 118 may be a conventional roller cone or a so-called PDC type bit having suitable drilling or chip evacuation fluid passages 121 and 123 formed therein and in fluid flow receiving communication with the passage 116.

In drilling earth formation material as well as in certain other material removal operations, the dislodgement and evacuation of material from the drilled hole, such as the wellbore 106, may be enhanced by causing the fluid occupying the annular space 111 to be subjected to pressure pulses which will assist in the wellbore formation process. In this regard, the sub 102 is configured similar to the apparatus 70 wherein the transverse wall portion 112 is provided with plural passages 113 which are arranged in a circumferentially spaced pattern, similar to the pattern of the fluid inlet passages 28 for the apparatus 20, as shown in FIG. 2, for inducing spiral or vortical flow of fluid within the chamber 108. A pulsation generating ball member 125 is disposed in the chamber 108 and is engageable with a curved wall portion 130 interconnecting the sub-bottom wall 114 and the cylindrical side wall 110. The member 125 is operable to momentarily cover plural circumferentially spaced fluid discharge passages 132 formed in the body 102. The passages 132 terminate at discharge ports 133 formed in an annular transverse shoulder 135 of the body 102. Four equally spaced passages 132 is a preferable arrangement. Pressure fluid is discharged from the chamber 108 into the wellbore annulus 111 but is subjected to vortical flow through the chamber 108 and the momentary interruption of flow which generates pressure pulses in the wellbore to enhance the drilling operation.

In operation of the apparatus 100, pressure fluid is conducted down through the tubing string 104 in a conventional manner, flows through the passages 113 to induce spiral, vortical flow in the chamber 108, and inducing traversal of the ball member 125 around the chamber 108 along the curved wall 130 whereby fluid being ejected through the passages 132 is momentarily sequentially interrupted as the ball member orbits within the chamber. A portion of the fluid flowing through the chamber 108 exits through the passage 116, flows through the passages 123 and 121 in the bit 118 and is ejected therefrom to evacuate chips from the end face 107 of the wellbore for flow up through the annulus 111. However, fluid occupying the wellbore space in the vicinity of the face 107 is subjected to pressure pulses due to the portion of the fluid being ejected through the passages 132. This pulsed flow assists in the breakup of material being removed from the face 107 as the wellbore is being formed by the bit 118. Moreover, the fluid ejected from the passages 132 does, of course, help in conveying drill cuttings up through the annulus 111 to the surface in a conventional manner.

The various embodiments of the apparatus described above may be constructed using conventional materials for fluid conveying or conducting devices such as any of the conventional engineering metals or plastics. The operation of the various embodiments of the fluid accelerating and pulsation generating apparatus described herein is believed to be understandable to those of skill in the art from the foregoing description. Although preferred embodiments of the invention have been described in some detail herein, those skilled in the art will also recognize that various substitutions and modifications may be made without departing from the scope and spirit of the appended claims.

What is claimed is:

1. Apparatus for generating pulsating fluid flow comprising:

a body having a generally cylindrical chamber formed therein and defined by a cylindrical inner wall and opposed generally transverse end walls and having a longitudinal central axis through said chamber;

fluid inlet passage means extending through a first one of said end walls, said inlet passage means being in communication with a source of pressure fluid for discharging pressure fluid into said chamber in a generally spiral manner and so as to create a fluid vortex in said chamber;

plural fluid discharge passages disposed in the opposite one of said end walls and having respective fluid inlet ports in communication with said chamber for receiving pressure fluid flow for discharging pressure fluid from said body; and pulsating flow generating means disposed in said body and operable to move in a generally circular path about said longitudinal central axis for periodically interrupting fluid flow through respective ones of said discharge passages to generate pulsed fluid flow from said apparatus.

2. The apparatus set forth in claim 1 wherein:

said pulsation generating means comprises a spherical ball member and said cylindrical inner wall intersects said opposite one of said end walls at a curved wall portion forming a raceway for said ball member.

3. The apparatus set forth in claim 2 wherein:

said discharge passages open into said chamber through said curved wall portion.

4. The apparatus set forth in claim 2 wherein:

said pulsation generating means comprises plural cylindrical ball members disposed in said chamber and operable to traverse said chamber in response to pressure fluid acting thereon.

5. Apparatus adapted to be interposed in a drill string for drilling a wellbore in the earth, said drill string including a section of drill pipe connected to one end of said apparatus and a drill bit connected to the opposite end of said apparatus, said apparatus comprising:

a body having a generally cylindrical chamber formed therein and defined by a cylindrical inner wall and opposed generally transverse end walls and having a longitudinal central axis through said chamber;

fluid inlet passage means extending through a first one of said end walls, said inlet passage means being in communication with a source of pressure fluid for discharging pressure fluid into said chamber in a generally spiral manner and so as to create a fluid vortex in said chamber;

plural fluid discharge passages disposed in the opposite one of said end walls and having respective fluid inlet ports in communication with said chamber for discharging pressure fluid from said body; and pulsating flow generating means disposed in said body and operable to move in a generally circular path about said longitudinal central axis for periodically interrupting fluid flow through respective ones of said discharge passages to generate pulsed fluid flow from said apparatus.

6. A well tool for cleaning perforations in a well casing with pressure fluid from a pressure fluid source, said tool comprising:

a body having a generally cylindrical chamber formed therein and defined by a cylindrical inner wall and opposed generally transverse end walls and having a longitudinal central axis through said chamber;

fluid inlet passage means extending through a first one of said end walls, said inlet passage means being in communication with said source of pressure fluid for discharging pressure fluid into said chamber in a generally spiral manner and so as to create a fluid vortex in said chamber;

plural fluid discharge passages disposed in the opposite one of said end walls and having respective fluid inlet ports in communication with said chamber for discharging pressure fluid from said body;

pulsating flow generating means disposed in said body and operable to move in a generally circular path about said longitudinal central axis for periodically interrupting fluid flow through respective ones of said discharge passages to generate pulsed fluid flow from said tool to effect cleaning particulate solids material from said perforation; and tubing means for conveying said tool within said well and for conducting pressure fluid to said chamber from said source.

7. An apparatus for accelerating fluid flow to minimize energy losses in said fluid flow through said apparatus comprising:

a body having a generally cylindrical chamber formed therein defined by a cylindrical inner wall and opposed generally transverse end walls and having a longitudinal central axis through said chamber;

fluid inlet passage means extending through a first one of said end walls, said inlet passage means being arranged to discharge fluid into said chamber in a generally spiral manner and to create a fluid vortex in said chamber; and plural fluid discharge passages disposed in the opposite one of said transverse end walls and in communication with said chamber for receiving fluid flow for discharging fluid from said body, said discharge passages being disposed at a predetermined angle with respect to a plane normal to said longitudinal central axis, and said discharge passages each having a central axis which is substantially tangential to said cylindrical inner wall to minimize pressure losses of fluid flowing into said discharge passages from said chamber.

8. An apparatus for accelerating fluid flow to minimize energy losses in said fluid flow through said apparatus comprising:

a body having a generally cylindrical chamber formed therein defined by a cylindrical inner wall and opposed generally transverse end walls and having a longitudinal central axis through said chamber;

fluid inlet passage means extending through a first one of said end walls, said inlet passage means being arranged to discharge fluid into said chamber in a generally spiral manner and to create a fluid vortex in said chamber;

the opposite one of said transverse end walls being joined to said cylindrical inner wall by a circumferential curved wall portion; and plural fluid discharge passages disposed in said opposite end wall and in communication with said chamber for receiving fluid flow for discharging fluid from said body, said discharge passages being disposed at a predetermined angle with respect to a plane normal to said longitudinal central axis to minimize pressure losses of fluid flowing into said discharge passages from said chamber.

9. The apparatus set forth in claim 8 including:

a discharge fluid pulsation generator disposed in said chamber and moveable about said chamber in contact with said curved wall portion.

10. The apparatus set forth in claim 9 wherein:

said pulsation generator comprises at least one spherical ball member.

11. The apparatus set forth in claim 10 wherein:

said pulsation generator comprises plural spherical ball members disposed in said chamber and operable to traverse said chamber along said curved wall portion in response to pressure fluid acting thereon.

12. The apparatus set forth in claim 10 wherein:

said discharge passages open into said chamber through said curved wall portion.

13. An apparatus for accelerating fluid flow to minimize energy losses in said fluid flow through said apparatus comprising:

a body having a generally cylindrical chamber formed therein defined by a cylindrical inner wall and opposed generally transverse end walls and having a longitudinal central axis through said chamber;

at least two fluid inlet passages extending through a first one of said end walls, said apparatus being in communication with fluid supply conduit means for causing fluid to flow through said inlet passages to said chamber, said inlet passages being arranged to discharge fluid into said chamber in a generally spiral manner and to create a fluid vortex in said chamber;

plural fluid discharge passages disposed in the opposite one of said transverse end walls and in communication with said chamber for receiving fluid flow for discharging fluid from said body, said discharge passages being disposed at a predetermined angle with respect to a plane normal to said longitudinal central axis to minimize pressure losses of fluid flowing into said discharge passages from said chamber; and said conduit means comprises a first conduit connected in fluid flow communication with one of said fluid inlet passages and a second conduit connected in fluid flow communication with another of said fluid inlet passages for discharging fluids into said chamber for mixing said fluids within said chamber and for discharge of a mixture of said fluids through said discharge passages.

14. The apparatus set forth in claim 13 wherein:

one of said conduits is connected to a source of particulate solids entrained in a carrier fluid for discharge into said chamber through one of said inlet passages.

15. An apparatus for accelerating fluid flow to minimize energy losses in said fluid flow through said apparatus comprising:

a body having a generally cylindrical chamber formed therein defined by a cylindrical inner wall and opposed generally transverse end walls and having a longitudinal central axis through said chamber;

at least two fluid inlet passages extending through a first one of said end walls, said apparatus being in communication with fluid supply conduit means for causing fluid to flow through said inlet passages to said chamber, said inlet passages being arranged to discharge fluid into said chamber in a generally spiral manner and to create a fluid vortex in said chamber;

said conduit means comprising a fluid conveying tubing string for conveying wellbore cleanout fluid to said body for ejecting said cleanout fluid from said body into a wellbore penetrating an earth formation zone;

plural fluid discharge passages disposed in the opposite one of said transverse end walls and in communication with said chamber for receiving fluid flow for discharging fluid from said body, said discharge passages being disposed at a predetermined angle with respect to a plane normal to said longitudinal central axis to minimize pressure losses of fluid flowing into said discharge passages from said chamber; and means in said chamber for generating pulsed flow of said cleanout fluid from said apparatus to effect cleaning of perforations extending from said wellbore into said earth formation zone.

16. An apparatus for accelerating fluid flow to minimize energy losses in said fluid flow through said apparatus comprising:

a body having a generally cylindrical chamber formed therein defined by a cylindrical inner wall and opposed generally transverse end walls and having a longitudinal central axis through said chamber;

at least two fluid inlet passages extending through a first one of said end walls, said apparatus being in communication with fluid supply conduit means for causing fluid to flow through said inlet passages to said chamber, said inlet passages being arranged to discharge fluid into said chamber in a generally spiral manner and to create a fluid vortex in said chamber;

plural fluid discharge passages disposed in the opposite one of said transverse end walls and in communication with said chamber for receiving fluid flow for discharging fluid from said body, said discharge passages being disposed at a predetermined angle with respect to a plane normal to said longitudinal central axis to minimize pressure losses of fluid flowing into said discharge passages from said chamber; and said conduit means comprising a tubing string extending within a wellbore for conducting pressure fluid into said wellbore through said apparatus to generate a vortex within fluid disposed in said wellbore sufficient to provide a reduced pressure region within said wellbore to induce flow of fluid from said earth formation zone into said wellbore.

17. An apparatus for accelerating fluid flow to minimize energy losses in said fluid flow through said apparatus comprising:

a body having a generally cylindrical chamber formed therein defined by a cylindrical inner wall and opposed generally transverse end walls and having a longitudinal central axis through said chamber;

at least two fluid inlet passages extending through a first one of said end walls, said apparatus being in communication with fluid supply conduit means for causing fluid to flow through said inlet passages to said chamber, said inlet passages being arranged to discharge fluid into said chamber in a generally spiral manner and to create a fluid vortex in said chamber;

plural fluid discharge passages disposed in the opposite one of said transverse end walls and in communication with said chamber for receiving fluid flow for discharging fluid from said body, said discharge passages being disposed at a predetermined angle with respect to a plane normal to said longitudinal central axis to minimize pressure losses of fluid flowing into said discharge passages from said chamber;

said conduit means comprising a drill string, said body being interposed between said drill string and a drill bit connected to said body at a fluid discharge end portion thereof; and said apparatus includes means disposed in said chamber and operable to discharge drilling fluid through said discharge passages in pulsed flow to assist in extending a wellbore with said drill string through an earth formation.

18. A method for removing solids particulates from a wellbore formed in an earth formation comprising the steps of:

providing a body connected to an elongated tubing string, said body including a cylindrical chamber delimited by opposed end walls, fluid inlet passage means disposed in one of said end walls and a plurality of fluid discharge passages disposed in the other of said end walls and opening to the exterior of said body, said discharge passages being arranged to induce vortical fluid flow in said wellbore;

providing a pressure pulsation generating member disposed in said chamber; and traversing said body into said wellbore connected to said tubing string and causing fluid to flow through said tubing string and through said chamber to exit said body through said discharge passages to induce a vortex in fluid in said wellbore to effect at least one of dislodging material accumulated on the walls of an earth formation in communication with said wellbore and stimulation of fluid flow from said earth formation into said wellbore, said pulsation generating member being responsive to fluid flowing through said chamber to effect pulsed flow of fluid from said discharge passages to assist in dislodging material from said earth formation for removal from said wellbore.

19. A method for removing solids particulates from a wellbore formed in an earth formation comprising the steps of:

providing a body connected to an elongated tubing string, said body including a cylindrical chamber delimited by opposed end walls, fluid inlet passage means disposed in one of said end walls and a plurality of fluid discharge passages disposed in the other of said end walls and opening to the exterior of said body, said discharge passages being arranged to induce vortical fluid flow in said wellbore, said body being interposed in said tubing string between a drill bit and said tubing string and said body including a pulsed flow generating member disposed in said chamber;

traversing said body into said wellbore connected to said tubing string and causing fluid to flow through said tubing string, said chamber and said drill bit to evacuate drill cuttings from an end face of said wellbore; and causing at least a portion of the fluid flow from said tubing string to induce movement of said pulsed flow generating member within said chamber to effect pulsed fluid flow exiting said body through said discharge passages in the vicinity of said end face of said wellbore to assist in removing material from said end face for evacuation from said wellbore and to induce a vortex in fluid in said wellbore to effect at least one of dislodging material accumulated on the walls of an earth formation in communication with said wellbore and stimulation of fluid flow from said earth formation into said wellbore.

20. An apparatus for accelerating fluid flow to minimize energy losses in said fluid flow through said apparatus comprising:

a body having a generally cylindrical chamber formed therein defined by a cylindrical inner wall and opposed generally transverse end walls and having a longitudinal central axis through said chamber;

fluid inlet passage means extending through a first one of said end walls and intersecting a plane normal to said longitudinal central axis at an angle of from 30° to 60°, said inlet passage means being arranged to discharge fluid into said chamber in a generally spiral manner about said longitudinal central axis and to create vortical fluid flow in said chamber about said longitudinal central axis; and plural fluid discharge passages disposed in the opposite one of said transverse end walls and in communication with said chamber for receiving fluid flow for discharging fluid from said body, said discharge passages being disposed at an angle of from 30° to 60° with respect to a plane normal to said longitudinal central axis, and said discharge passages each have a central axis which extends in a direction substantially aligned with the direction of vortical fluid flow in said chamber with respect to said cylindrical inner wall to minimize pressure losses of fluid flowing into said discharge passages from said chamber.

* * * * *